US011771623B2

(12) United States Patent
Duriez et al.

(10) Patent No.: US 11,771,623 B2
(45) Date of Patent: Oct. 3, 2023

(54) CONTAINER FOR A PHARMACEUTICAL COMPOSITION

(71) Applicant: West Pharmaceutical Services, Inc., Exton, PA (US)

(72) Inventors: Douglas R. Duriez, Morgantown, PA (US); Bryan F. Allard, West Chester, PA (US); Brett Andrejko, Downingtown, PA (US); William R. Schleppy, Mohnton, PA (US)

(73) Assignee: West Pharmaceutical Services, Inc., Exton, PA (US)

( * ) Notice: Subject to any disclaimer, the term of this patent is extended or adjusted under 35 U.S.C. 154(b) by 35 days.

(21) Appl. No.: 17/684,775

(22) Filed: Mar. 2, 2022

(65) Prior Publication Data

US 2022/0280383 A1 Sep. 8, 2022

Related U.S. Application Data

(60) Provisional application No. 63/155,488, filed on Mar. 2, 2021.

(51) Int. Cl.

| | |
|---|---|
| ***A61J 1/14*** | (2023.01) |
| ***A61J 1/10*** | (2006.01) |
| ***B65B 3/00*** | (2006.01) |

(52) U.S. Cl.

CPC ..... *A61J 1/1468* (2015.05); *A61J 1/10* (2013.01); *A61J 1/1412* (2013.01); *B65B 3/003* (2013.01)

(58) Field of Classification Search

CPC ..... A61J 1/1468; A61J 1/10; A61J 1/1412; B65B 3/003

USPC ..... 206/569, 570

See application file for complete search history.

(56) References Cited

U.S. PATENT DOCUMENTS

| | | | | |
|---|---|---|---|---|
| 4,837,047 | A | 6/1989 | Sato | |
| 5,176,634 | A | 1/1993 | Smith | |
| 5,968,453 | A * | 10/1999 | Shugart | G01N 35/1002 220/555 |
| 5,985,218 | A * | 11/1999 | Goodale | B01L 3/508 206/569 |
| 9,643,133 | B2 * | 5/2017 | Goodwin | B01F 35/513 |
| 9,662,270 | B2 | 5/2017 | Nojima | |
| 10,589,197 | B2 * | 3/2020 | Rhodes | C12M 33/14 |
| 11,268,056 | B2 * | 3/2022 | Norderhaugh | C12M 1/266 |
| 2013/0126388 | A1 * | 5/2013 | Hannahan | A61F 13/5519 206/570 |

(Continued)

FOREIGN PATENT DOCUMENTS

| | | |
|---|---|---|
| CA | 3109725 | 2/2020 |

*Primary Examiner* — Jacob K Ackun

(74) *Attorney, Agent, or Firm* — Blank Rome LLP

(57) ABSTRACT

A container for storing a pharmaceutical composition includes a body portion having an elastomeric material, and an inner lining having a thermoplastic material covering at least a portion of an inner surface of the body portion. The container forms an internal chamber for storing the pharmaceutical composition, where the internal chamber is bounded by the inner surface of the body portion. The inner lining provides a barrier between the elastomeric material and the pharmaceutical composition, thus protecting the pharmaceutical composition. Associated methods of storing the pharmaceutical composition within the container, as well as manufacturing the container, are also described.

22 Claims, 10 Drawing Sheets

(56) References Cited

U.S. PATENT DOCUMENTS

| | | | | |
|---|---|---|---|---|
| 2016/0000062 | A1* | 1/2016 | Chen | A61J 1/10 435/1.3 |
| 2017/0135900 | A1* | 5/2017 | Yano | A61J 1/00 |
| 2017/0175066 | A1* | 6/2017 | Olsen | A61J 1/12 |
| 2021/0214538 | A1* | 7/2021 | Nakao | B32B 27/18 |
| 2022/0016348 | A1* | 1/2022 | Abrams | C09D 183/04 |
| 2022/0031566 | A1* | 2/2022 | Sanchez | A61J 1/1468 |
| 2022/0054356 | A1* | 2/2022 | Liao | C08L 67/02 |

* cited by examiner

CONTAINER FOR A PHARMACEUTICAL COMPOSITION

CROSS REFERENCE TO RELATED APPLICATIONS

This application claims the benefit of priority to U.S. Provisional Patent Application No. 63/155,488, filed Mar. 2, 2021, the disclosure of which is hereby incorporated by reference herein.

FIELD OF THE INVENTION

The present disclosure generally relates to a container for storing pharmaceutical compositions, as well as associated methods of use and manufacture.

BACKGROUND

Containers for storing medicaments or drugs for healthcare purposes are designed to ensure such compositions are stored in a contaminant-free manner, as any contamination of the composition may render it unsafe or ineffective. Moreover, the material of the container is generally selected to ensure an acceptable shelf life for the medicinal composition stored within the container. Liquified or gaseous compositions are often stored in sealed vials, which often comprise a plastic or glass body with an open end, and are sealed by a stopper. Pharmaceutical compositions are also often stored in pre-filled syringes or cartridges, which can be inserted into automatic injection devices configured to expel the medicament from the container.

Medicine bags are also used to store the pharmaceutical compositions, which are often administered in liquid form. Drugs which are easily degenerated by moisture or oxygen should be stored in a sealed container, however, some liquid drugs require mixing with other drugs. To prepare such liquid drugs, needles have widely been used to access the liquid in the container so that the liquid drug can be drawn into a syringe. Furthermore, some flexible medicine containers include a plurality of chambers and partition means dividing the container into the chambers, while also permitting communication between the chambers. However, such conventional medicine containers detrimentally permit penetration therein of moisture or gas. As a result, there is a need to place the container into an expensive outer bag having barrier properties against moisture and gas when the container is used for separately preserving the stored medicine in order to protect it from becoming contaminated or unstable over time.

Moreover, conventional medicinal bag and closure systems that comprise only thermoplastic materials usually have issues with drug compatibility. The construction of common medicinal bags also results an inability to provide the necessary barrier to oxygen and moisture required to protect the composition stored therein. Many conventional medicinal bags also lack sufficient mechanical properties, such as strength, and thus fail to have sufficient resealability after a needle puncture.

Accordingly, there is a clear and substantial need for a pharmaceutical drug container that solves these aforementioned problems of conventional pharmaceutical containers by providing a flexible elastomeric containment vessel using materials suitable for drug contact. A further goal is to provide such a container that is highly resistant to breakage, and which may be pierced by a needle for the extraction of single dose or medicine or multiple drug doses, wherein such a container may form unique shapes and comprise multiple chambers where fluids are able to be circulated and/or mixed between the chambers. A further goal is to provide a container which facilitates pneumatic, mechanical, electro-mechanical, and/or hydraulic driven expulsion of the liquid medicine therein.

SUMMARY

The foregoing needs are met, to a great extent, by a flexible drug containment vessel, such as a bag or bladder, made of a pharmaceutical grade thermoset elastomer rubber and comprising an internal thermoplastic lining which provides a barrier between the drug being contained and the rubber material which constitutes the flexible containment structure. Such a multilayer bag may comprise a layer of pharmaceutical grade thermoset elastomer and one or more layers of thermoplastic film, which together provide the structure around a void where a liquid drug product is contained.

In a first aspect there is provided a container for a pharmaceutical composition. The container comprises a body portion comprising an elastomeric material and a lining comprising a thermoplastic material covering at least a portion of an inner surface of the body portion. The container forms an internal chamber for storing the pharmaceutical composition, wherein the internal chamber is bounded by the inner surface of the body portion. The lining is configured to provide a barrier between the elastomeric material and the pharmaceutical composition. As the body portion comprises an elastomeric material, the container provides a flexible containment structure in which a drug product is contained. Such a container may also provide high resistance to breakage, due to the strength of the elastomeric containment structure.

According to another aspect, the container may be compatible with extreme temperatures (such as the cryogenic temperatures often used to store biologics). In some embodiments, the container may be sealed closed e.g. without any openings, by heat sealing, mechanical sealing or chemical sealing lining and/or the body portion around a periphery of the chamber). This can avoid the need to maintain a separate seal between the container and a separate closure member, such as a stopper. Moreover, in embodiments in which the container comprises an opening, the container may be sealed by mechanically sealing the body portion and/or the lining material together, e.g. using a clip or other mechanical closing means. Yet further, in embodiments comprising a separate closure member (e.g. a stopper), the container may be better adapted to withstand cryogenic temperatures without compromising the seal integrity because the container body and the closure member may be made of the same material (e.g. an elastomeric material).

According to another aspect, the elastomeric material may comprise a thermoelastic elastomer and/or a thermoset elastomer. The properties of such materials may allow for a robust and strong containment structure, which is not compromised by heat.

According to another aspect, the elastomeric material is optionally a pharmaceutical grade elastomer. It may comprise one or more of: polyisoprene, polybutadiene, styrene-butadiene copolymers, ethylene-propylene copolymers, ethylene-propylene-diene copolymers, chlorosulphonated polyethylene, ethylene-vinyl acetate copolymer, styrene-isoprene copolymers, fluoroelastomers, butyl rubber, isoprene rubber, butadiene rubber, halogenated butyl rubber, ethylene propylene terpolymer, silicone rubber, and combinations thereof.

According to another aspect, the use of an elastomeric material may enable the creation of containers of unique shapes, due to the flexibility of the elastomer and the ability to mold the elastomer into a given shape. Thus, the elastomeric container may be shaped to accommodate the internal volume of a medical device. Typically, medical devices such as autoinjectors must be designed in order to accept a standard size containers (e.g. a syringe, a glass cartridge and the like). As the elastomeric container may be easily formed into unique shapes, this issue is no longer a constraint on the design process for medical devices.

According to another aspect, the potential to mold the elastomeric material into a desired shape may further provide the ability to incorporate external features in the formation of the container. Such features may include a septum (such as a dividing wall between two internal chambers), valves, mechanical closures and the like. This may allow the container to accommodate design features of delivery devices.

According to another aspect, the use of a plunger is not required to expel the contents of the container. The internal volume of the container may be pressurized to expel the internal fluid after piercing the container with a needle. Alternatively, external compression may be applied to the container in order to expel the contents.

According to another aspect, due to the elastomeric material of the container, the container may be resealable upon puncture.

According to another aspect, the thermoplastic material may comprise tetrafluoroethylene, polytetrafluoroethylene (PTFE), ethylene tetrafluoroethylene (ETFE), fluorinated ethylene propylene (FEP), polyvinylidene fluoride (PVF), polyvinylidene difluoride (PVDF), polychlorotrifluoroethylene (PCTFE), perfluoroalkoxy alkanes (PFA), ethylene chlorotrifluoroethylene (ECTFE), perfluoroelastomer (FFPM), fluoroelastomer polymer (FPM), polyethylene (PE), cyclic olefin polymer (COP), cyclic olefin copolymer (COC), polypropylene (PP), and combinations thereof.

According to another aspect, the lining may comprise a laminate of a plurality of sheets, wherein at least one sheet comprises a thermoplastic material. The lining may comprise multiple sheets of thermoplastic material.

According to another aspect, the thermoplastic lining provides a barrier between the pharmaceutical composition being contained, and the elastomer of the containment structure. This may provide protection from potential extractables and leachables from the elastomeric material and thus prevent the contamination of the pharmaceutical composition from said extractables and leachables.

According to another aspect, the presence of a thermoplastic lining ensures that the pharmaceutical composition is not in contact with materials which are incompatible with drug storage. The pharmaceutical composition stored in the container may also be provided protection from light, gas, liquid and solid contaminants due to the presence of the thermoplastic and elastomer layers.

According to another aspect, the container may comprise a plurality of inner chambers, each of the inner chambers being bounded by the inner surface of the body portion. In this way, the container may provide more than one internal chamber for the storage of one or more pharmaceutical compositions in separate compartments. The container may be divided into two or more segregated inner chambers, each separated by a septum formed by sealing the thermoplastic lining and the elastomeric material to each other so that each inner chamber is bounded by the inner surface of the body portion of the container. This configuration may provide a containment device in which to store multiple doses of a pharmaceutical composition, or a device in which to store multiple different pharmaceutical compositions.

According to another aspect, the plurality of internal chambers may be fluidly connected to each other via a channel. The channel may extend through the septum and may be sealed by a breakable seal so that multiple compositions may be prevented from mixing until the seal is broken. Alternatively, a seal between the layers of the septum may be weakened at a predetermined point to provide a rupturable seal that forms the channel between the internal chambers once broken.

According to another aspect, it will be appreciated that configurations comprising multiple internal chambers may provide a containment device in which different pharmaceutical compositions may be stored separately until such time as they are to be mixed. A transition from the aforementioned segregated inner chambers to the connected inner chambers may be facilitated by breaking the seal between the two chambers, through an adjustment of the septum or shared wall between the chambers. The separation between the two chambers may also be permanent, and the breakable seal omitted entirely.

According to another aspect, the container may further comprise an access port having an internal via fluidly connected to the internal chamber. This may facilitate pneumatic, mechanical, electro-mechanical, and/or hydraulic driven expulsion of the pharmaceutical composition stored within the container. It may also provide an access point for extraction or delivery of the pharmaceutical composition via a needle. Thus, multiple doses of a pharmaceutical composition may be stored in such a container, and the doses may be extracted individually without detriment to the pharmaceutical composition itself.

According to another aspect, the access port may comprise the elastomeric material and extend from the body portion of the container. The internal via may have a surface, wherein at least a portion of the surface is covered by the lining.

According to another aspect, the access port may have a sealed end. The sealed end may be resealable. The sealed end may be configured to be pierced by a needle. The sealed end may be formed of an elastomeric material. The elastomeric end may allow the container to reseal after piercing by a needle. Thus, multiple doses of a pharmaceutical composition may be stored in such a container, and the doses may be extracted individually without detriment to the pharmaceutical composition itself.

According to another aspect, the access port may extend from the body portion of the container and comprise an open end sealed with a closure device. This closure device may be a mechanical seal. For example, the closure device may be an elastomeric stopper.

According to another aspect, in some configurations, the container may include a plurality of inner chambers, wherein, for each inner chamber, the container comprises an access port having an internal via fluidly connected to the respective inner chamber. In this manner, the container may comprise several access ports, each accessing one or more of the plurality of inner chambers. These access ports may have a sealed end which is optionally resealable, and/or an open end sealed with a closure device. An example of such a closure device is an elastomeric stopper. Individual access ports may differ, and as such a container may comprise of both sealed, unsealed and resealable access ports, as needed.

According to another aspect, the formation of a container with multiple inner chambers may facilitate a device using pneumatically (vacuum) driven extraction of blood/fluids into a diagnostic device with subsequent routing for in-device testing or monitoring. Alternatively, such a container may facilitate a platform for a bioreactor for cell and gene therapies.

According to another aspect, any of the implementations described above may be incorporated into a drug delivery device. Such a drug delivery device may involve the pneumatic, mechanical, electro-mechanical, and/or hydraulic driven expulsion of drugs from the container. For example, the expulsion of the drug stored in the container may be driven by a gas pressurized outer container, or by a gas producing reaction. The drug expelled from the container may enter another component of the drug delivery device, in order to facilitate drug delivery. The expulsion of the drug stored in the container in this manner may facilitate contaminant-free drug delivery, as it would not be necessary to transfer the drug from the container to the drug delivery device using an external mechanism, such as a syringe or filling device.

According to another aspect, there is provided a method of storing a pharmaceutical composition, the method comprising: filling an internal chamber of a container with a pharmaceutical composition, wherein the container comprises: a body portion comprising an elastomeric material and a lining comprising a thermoplastic material covering at least a portion of an inner surface of the body portion; and wherein the lining provides a barrier between the elastomeric material and the pharmaceutical composition.

According to another aspect, there is also provided a method of manufacturing a container for a pharmaceutical composition, the method comprising: forming a chamber having an internal volume wherein the chamber comprises a body portion comprising an elastomeric material and a lining comprising a thermoplastic layer on an inner surface of the body portion.

According to another aspect, the method of manufacturing may comprise first forming a bladder from the thermoplastic lining material to form the internal chamber, and subsequently forming the body portion around the bladder and curing the elastomeric material of the body.

According to another aspect, the method of manufacturing may further comprise leaving a section of an edge of the body portion unsealed so that an opening is formed in the inner lining.

There has thus been outlined certain aspects of the present disclosure in order that the detailed description thereof herein may be better understood, and in order that the present contribution to the art may be better appreciated. There are additional aspects of the present disclosure that will be described below and which form the subject matter of the claims appended hereto.

In this respect, before explaining at least one aspect of the present drug containers in detail, it is to be understood that the drug containers are not limited in their application to the details of construction and to the arrangements of the components set forth in the following description or illustrated in the drawings. The drug containers are capable of aspects in addition to those described, and of being practiced and carried out in various ways.

BRIEF DESCRIPTION OF THE DRAWINGS

In order that the present disclosure may be readily understood, aspects of the drug containers are illustrated by way of non-limiting examples in the accompanying drawings, in which like parts are referred to with like reference numerals throughout.

DETAILED DESCRIPTION

The present disclosure is directed generally to containers for storing pharmaceutical compositions that provide a flexible containment structure in which a pharmaceutical composition may be stored. The container, which may take the form of a bladder or pouch, may include an internal chamber that may be made from thermoplastic film having barrier properties suitable for protecting pharmaceutical compositions from potential contaminants and/or contact with materials with which the composition may interact (e.g. to shorten the shelf life of the composition).

An elastomeric material (e.g., a pharmaceutical grade elastomer, such as a thermoset elastomer) is molded around the internal chamber to form an outer shell or body portion, with the thermoplastic film forming an inner lining. The combination of the inner lining and the outer shell or body portion may provide a safe container for compositions which is robust and resistant to breakage. The container described herein may be particularly suited to use in storing one or more pharmaceutical compositions which may be readily extracted through the use of a needle, or optionally through an access port extending from the body of the container.

Figure 1:
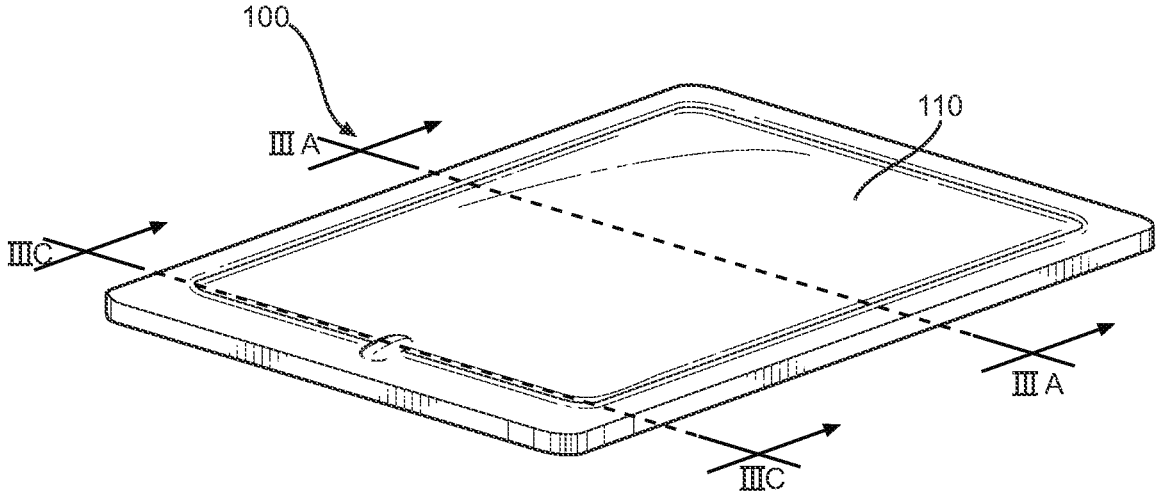
FIG. 1 shows a top perspective view of a drug container according to the present disclosure.

FIG. 1 shows an external view of a container 100 according to the present disclosure. The container 100 includes a body portion 110 which is formed from an elastomeric material. According to some aspects, this elastomeric material may be a thermoset elastomer, and furthermore may be a pharmaceutical grade elastomeric material, such as a material comprising a polymer selected from the group consisting of polyisoprene, polybutadiene, styrene-butadiene copolymers, ethylene-propylene copolymers, ethylene-propylene-diene copolymers, chlorosulphonated polyethylene, ethylene-vinyl acetate copolymer, styrene-isoprene copolymers, fluoroelastomers, butyl rubber, isoprene rubber, butadiene rubber, halogenated butyl rubber, ethylene propylene terpolymer, silicone rubber, and combinations thereof. The body portion 110 may provide an outer shell layer of the container 100 in order to protect its contents.

A substantially rectangular container is illustrated in FIG. 1 and throughout the present disclosure. However, while the container 100 is illustrated as a substantially rectangular containment pouch, it may be molded into many other desired shapes due to the use of the elastomeric material to form the body portion 110 of the container 100. Thus, the present disclosure extends to those shapes which may be formed with the elastomeric material. For instance, the container 100 may be formed having a square shape, a circular shape, or an oval shape, among other shapes. Such shapes may be achieved through the use of, for example, a compression mold, injection molding or extrusion.

Figure 2:
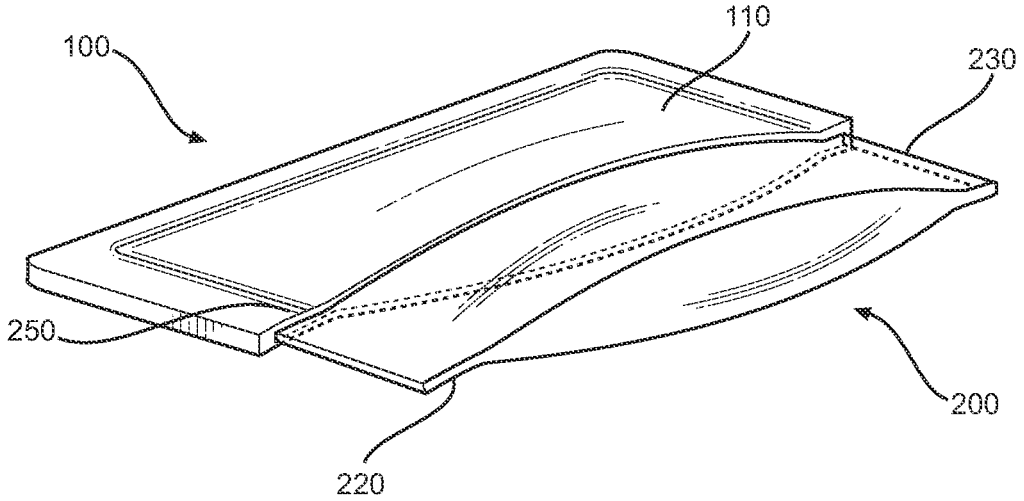
FIG. 2 shows a cutaway view of the drug container of FIG. 1.

FIG. 2 shows a cutaway view of the container 100, wherein a section of the body portion 110 has been omitted to reveal the internal structure of the container. In particular, within the body portion 110, an inner lining 200 is provided which is made from a thermoplastic material. The inner lining 200 covers at least a portion of an inner surface of the body portion 110 and in some aspects may cover all of the inner surface of the body portion 110. The inner lining 200 may be made from a thermoplastic film, and preferably an inert film, such as a fluoropolymer film that will not react with the contents of the pouch formed by the inner lining.

Furthermore, the inner lining 200 may comprise tetrafluoroethylene, polytetrafluoroethylene (PTFE), ethylene tetrafluoroethylene (ETFE), fluorinated ethylene propylene (FEP), polyvinylidene fluoride (PVF), polyvinylidene difluoride (PVDF), polychlorotrifluoroethylene (PCTFE), perfluoroalkoxy alkanes (PFA), ethylene chlorotrifluoroethylene (ECTFE), perfluoroelastomer (FFPM), fluoroelastomer polymer (FPM), polyethylene (PE), cyclic olefin polymer (COP), cyclic olefin copolymer (COC), polypropylene (PP), and combinations thereof.

In the implementation shown in FIG. 2, the inner lining 200 is formed from a first sheet 230 and a second sheet 220, wherein the first and second sheets are sealed to each other around their respective peripheries to define the internal chamber. The body portion 110 may surround the inner lining 200, thereby encasing and protecting the inner lining 200 and its contents. In some implementations, a plurality of laminate thermoplastic sheets may form the inner lining, with each sheet including at least one thermoplastic material. Thus, the first sheet 230 and second sheet 220 as shown may comprise several layers of sheets. In other implementations, the inner lining may be formed from a single sheet, which may be folded and sealed along its outer periphery in order to line the inner surface of the body portion 110.

The inner lining 200 is provided on at least a portion of an inner surface of the body portion 110. For instance, the inner lining 200 may be attached to the inner surface of the body portion 110, which may be achieved through the molding of the body portion 110 such that it adheres to the inner lining 200. Alternatively, the inner lining may not be attached to the inner surface of the body portion 110, such that the molding of the body portion 110 surrounds, but does not adhere to, the inner lining 200.

Figure 3A:
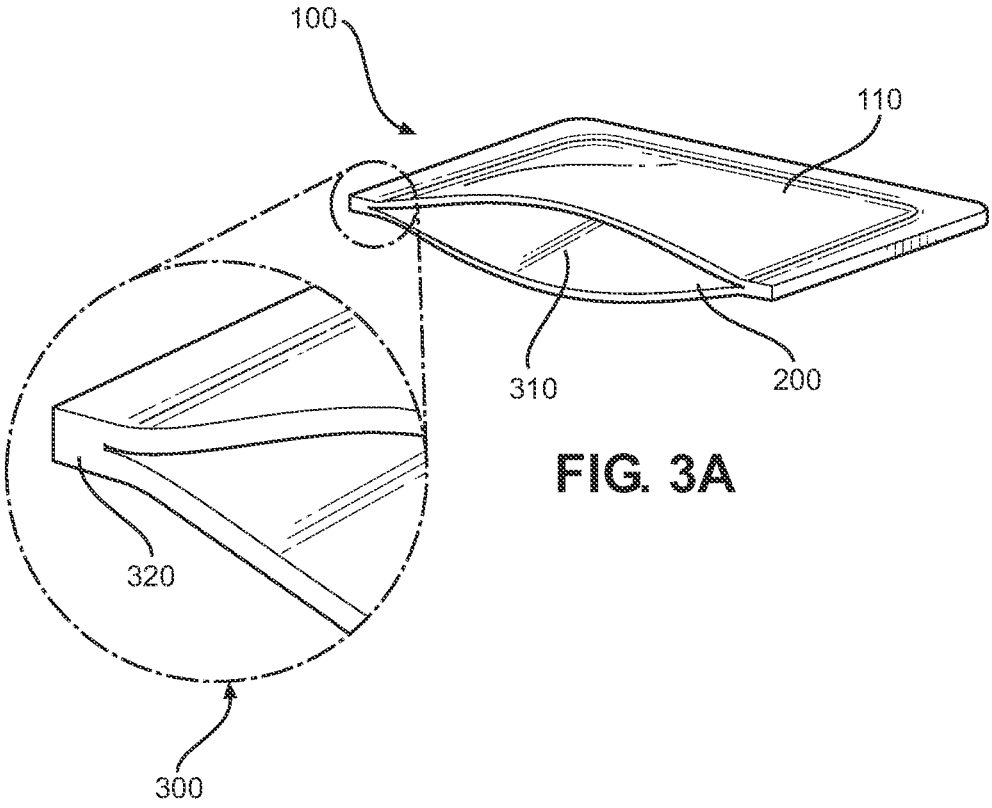
FIG. 3A shows a cross-sectional perspective view of the drug container of FIG. 1 taken along line IIIA-IIIA.

FIG. 3A shows a cross-sectional view of the container 100, along with a detailed magnified view 300 of an edge 320 of the container 100. The cross-sectional view of the container 100 illustrates an internal chamber 310 in which a pharmaceutical composition may be stored. The internal chamber 310 is bounded by the inner lining 200 and the body portion 110, and constitutes an enclosed volume in which the pharmaceutical composition may be stored. Thus, the inner lining 200 forms a barrier between any pharmaceutical composition stored in the internal chamber 310 and the elastomeric material of the body portion 110. Further, the detailed view 300 illustrates that at the edge 320 of the container 100, the first sheet 230 and the second sheet 220 of the inner lining 200 are joined together in a manner which creates a seal, thus creating the internal chamber 310. Such a seal may be achieved by heat sealing, ultrasonic welding, applying pharmaceutical grade adhesives, and the like. The body portion 110 of the container 100 extends around the sealed edge of the inner lining 200.

Figure 3B:
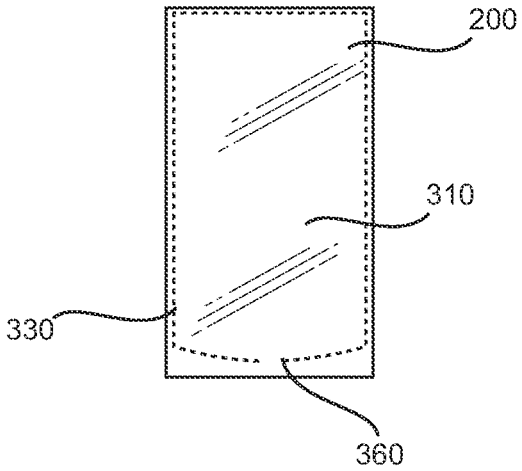
FIG. 3B shows a schematic illustration of one embodiment of the internal chamber of the drug container.

FIG. 3B shows a schematic illustration of the inner lining 200 in one embodiment of the container. The first and second sheets 230, 220 of the inner lining 200 are joined by a seal 330 which is provided at or near the outer edges of each sheet 230, 220. Moreover, the internal chamber 310 is located within the boundaries defined by the seal 330. In this embodiment, a rectangular internal chamber 310 is formed for the storage of pharmaceutical compositions. However, an internal chamber of any shape or volume may be formed by adapting the location of the seal 330. Also, multiple inner chambers may be provided by adapting the shape and position of the seal 330. The inner lining 200 further includes an opening 360 to facilitate insertion and/or expulsion of a pharmaceutical composition to and/or from the internal chamber 310. This opening 360 is formed by an unsealed section where there is a gap in the seal 330, such that the individual sheets 230, 220 in the unsealed section may be separated.

Figure 3C:
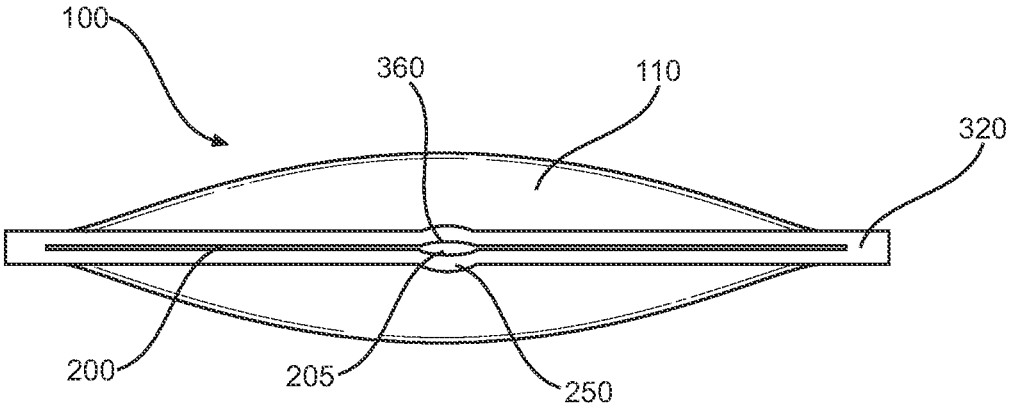
FIG. 3C shows a cross-sectional front view of the container of FIG. 1 taken along line IIIC-IIIC.

Referring to FIG. 3C, a cross-sectional view of the container across an access region 250 of the body portion 110 is illustrated. The access region 250 defines a pocket formed in the edge 320 of the body portion. As shown, the opening 360 formed by the unsealed portion between the first and second sheets of the inner lining aligns with the pocket of the access region 250, thus forming an internal conduit 205 through which a composition may escape the internal chamber 310 of the container. For instance, a user may pierce the pocket of the access region 250 with a syringe needle, such that the needle tip is inserted through the opening 360 of the inner liner to access and withdraw the pharmaceutical composition stored inside the internal chamber 310. To seal the container, a mechanical closure member such as a clip may be used to compress the opposing sheets of the inner lining together, such as across the access region 250 of the body portion 110, thereby releasably closing the opening 360 of the container. In other implementations, the seal 330 may fully enclose the internal chamber 310 such that no opening is formed between the first and second sheets of the inner lining.

Figure 4A:
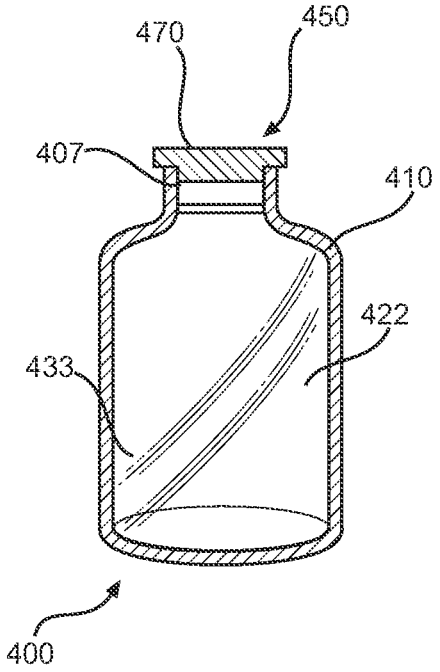
FIG. 4A shows a partial sectional view of an embodiment of a drug container comprising an access port.

FIG. 4A illustrates another implementation of a container 400. The container 400 comprises a generally cylindrical body, similar to a conventional glass vial, as opposed to the pouch type container 100 described above with respect to FIGS. 1 to 3. These features of the container 400 may have similar properties to the corresponding features of the container 100 described above. For instance, although the shape of the container 400 differs from the shape of container 100, container 400 nonetheless includes a body portion 410 within which there is provided an inner lining 422 that defines an internal chamber 433 similar to the internal chamber 310 formed by the inner lining 200 of container 100. Moreover, the container 400 also includes an access port 450. The access port 450 includes an internal via 405 (also referred to as a conduit or passage) through which the internal volume of the chamber 433 may be accessed by the user in order to insert or extract the pharmaceutical composition into or out of the container 400, respectively. The internal via 405 includes an inner surface 407, wherein at least a portion of the inner surface 407 is covered by the inner lining 422.

Furthermore, the access port 450 extends outwardly from the body portion 410 of the container 400. The access port 450 may be formed as a section of the body portion 410 of the container 400. According to some aspects, the access port 450 may be formed from an elastomeric material. In some aspects, the access port 450 may be shaped to engage with or couple to external devices. For example, the access port may be shaped to allow attachment to an auto injector device, or to facilitate pneumatically driven extraction into a diagnostic device.

The access port 450 preferably includes a closure device 470 configured to seal the access port 450. In some implementations, the closure device 470 may be a clip, a fastener or other similar external closure device, that is configured to compress the access port 450, and thereby close the internal via 405. In other implementations, the closure device 470 may be an elastomeric stopper or other similar device for closing an opening of the access port 450, and thus sealing the internal via 405. For example, such a closure device 470 is shaped to be received by the internal via 405 and configured to form a seal against the inner surface 407 of the internal via 405. In some implementations, the access port 450 may not include a closure device 470, and instead the access port may be closed by sealing the inner walls of the via 405 together, or otherwise integrally forming a closure with the main body portion 410 of the container 400. In such implementations, the seal may be formed by chemical, mechanical or thermal bonding of the materials of the container.

Figure 4B:
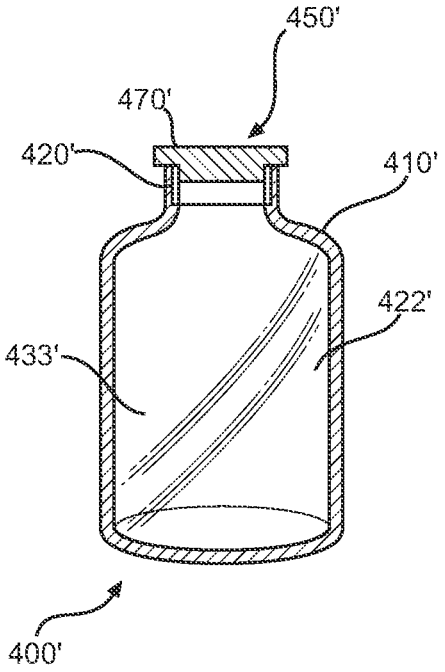
FIG. 4B shows a partial sectional view of another embodiment of a drug container comprising an access port.

FIG. 4B shows another container 400', which is similar to the container 400 shown in FIG. 4A. Like the embodiment shown in FIG. 4A, the container 400' comprises an internal chamber 433' closed by a closure device 470', such as an elastomeric stopper or other type of closure member configured to seal an internal via 405' of an access port 450'. An inner lining 422' is provided on or coats the interior surface of the internal chamber 433' to form a barrier between a composition contained within the chamber 433' and the elastomeric material that forms the main body 410' of the container 400'.

The container 400' further comprises a collar 420' positioned within a neck of the container. The collar 420' is configured to support the via 405' at an opening of the access port 450'. The collar 420' may also facilitate sealing between the closure device 470' and the container 400'. For example, the collar 420' may be formed from a rigid material, such as a hard plastic, that is overmolded with the elastomeric material of the main body 410'. In some implementations, the collar may be threaded or barbed in order to mate or form a seal with the outer surface of the closure device 470'. In other implementations, the threaded collar may be used to connect the container 400' to a mechanical device used to administer the pharmaceutical contents of the container 400'. According to some aspects, the collar 420' may have a generally smooth internal surface having an internal diameter that is greater than the outer diameter of the main portion of the closure device 470', such that a friction fit is provided upon inserting the closure device 470' into the collar 420'.

In order to minimize potential interaction between the contents of the container (400, 400') with the closure device (470, 470'), at least a portion of the outer surface of the closure device (470, 470'), preferably the portion of the outer surface that is likely to contact the contents of the container (400, 400'), may be covered with an inert film similar to the thermoplastic film used to form the inner lining (422, 422'). Furthermore, in order to provide an additional seal between the closure device (470, 470') and the main body (410, 410') of the container, the closure device (470, 470') may be made from an elastomeric material that is capable of fusing with the elastomeric material of the main body (410, 410') of the container. For example, as illustrated in FIGS. 4A and 4B, the closure device (470, 470') may be provided in the form of a vial stopper having an outwardly extending flanged portion. By manufacturing the closure device (470, 470'), or at least the flanged portion of the closure device, with the same or similar elastomeric material as the main body (410, 410'), the contact surfaces between the underside of the flanged portion and the top surface of the opening in the main body (410, 410') may be cured or fused together to provide an additional seal.

Due to the complexity of the shape of the container (400, 400'), it may be necessary to form the container in multiple molding steps. For example, in a first step, a partially cured tube having opposing open ends may be formed to provide the vertical walls of the main body (410, 410'), wherein the internal surfaces of the tube include the inner lining (422, 422'). In a second step, one of the open ends of the tube may be closed by curing or bonding the tube to an elastomeric layer having a thermoplastic film applied on the side of the elastomeric layer facing the tube in order to provide the base of the main body (410, 410'). In a further or finishing step, the container (400, 400') may also be provided with a neck having a diameter that is smaller than a diameter of the main body (410, 410') of the container.

Figure 5:
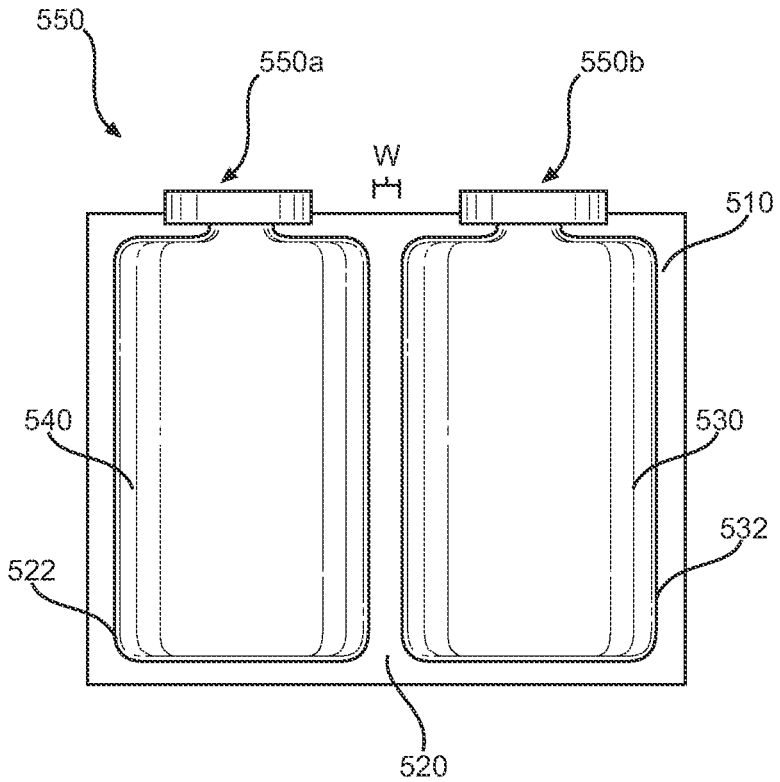
FIG. 5 is a schematic cross-sectional view of two inner chambers of another embodiment of a drug container.

Turning to FIG. 5, another implementation of the present disclosure is depicted, in which a container 500 comprises a plurality of inner chambers. The container 500 has a body portion 510 within which there is provided a first inner lining 522 that defines a first inner chamber 540, and a second inner lining 532 that defines a second inner chamber 530. These internal chamber and inner lining features of the container 500 have equivalent properties to the corresponding internal chamber and inner lining features of the container 100 previously described above. Providing two or more inner chambers allows different pharmaceutical compositions, or multiple doses of the same composition, to be stored in the corresponding inner chambers of the container 500.

As illustrated, the container 500 has a generally rectangular shape, although other shapes may be similarly provided. In some implementations, the inner lining 522 may define both the first inner chamber 540 and the second inner chamber 530. For instance, the inner first and second inner chambers 540, 530 may be defined by an inner lining formed from the same sheet of thermoplastic material or a plurality of sheets of thermoplastic material. More particularly, in the implementation shown, the container 500 comprises two separate inner chambers 540, 530 segregated by a septum 520 (also referred to as a wall). The septum 520 may be formed by first forming a chamber as described in connection with FIGS. 1 to 3 above, and then sub-dividing the resulting chamber into a plurality of individual chambers by sealing an edge portion of opposing faces on the inner lining together to form separate compartments, after which the first and second chambers 540, 530 may be encased in the elastomeric material of the body portion 510. According to other aspects, the plurality of chambers may be formed individually from separate sheets of thermoplastic material. The separate chambers may then be covered with thermoelastic material to form the main body portion of the container.

The septum 520 may be a breakable septum in order to provide a temporary barrier between the first and second inner chambers 540, 530. The septum 520 may further provide a mechanical seal between the inner chambers, which may be manipulated to allow mixing of the contents of the inner chambers. In some implementations, the septum 520 may comprise a frangible section which is easily broken or unsealed. For example, a width W of the seal formed by the septum 520 between adjacent inner chambers 540, 530 decrease across a portion of its length. In other implementations, the seal between the first and second chambers may also be weakened in other ways. Ways in which the septum 520 may be broken or removed include, for example, increasing an internal pressure in one chamber by applying a force to the container 500 until the septum 520 breaks. Further, heat may be applied to the septum 520 in order to weaken the frangible section of the septum so that it is easily broken with the application of pressure to the container 500.

Additionally or alternatively to the septum 520, mixing of the contents of the inner chambers may be achieved using a separate mixing device. In one implementation, such a mixing device may be provided that includes two or more separate needle tips having respective openings, and a lumen connecting the openings. The mixing device enables the corresponding two or more inner chambers to be pierced by the same device at the same time, via the separate needle tips, thereby allowing mixing (and optionally extraction) of the contents of the inner chambers.

As previously described, the container 500 shown in FIG. 5 comprises two substantially rectangular inner chambers 540, 530 within a substantially rectangular body portion 510. However, other implementations of the container may comprise inner chambers and/or body portions of differing shapes and volumes. In some implementations, there may be more than two separate inner chambers, segregated by a plurality of septa. Further, each of the first and second inner chambers 540, 530 includes a first access port 550*a* and a second access port 550*b*, respectively. Each of the first and second access ports 550*a*, 550*b* may be equivalent to the access port 450 previously described above with reference to FIG. 4A, and therefore will not be described further here. Although the implementation shown in FIG. 5 includes an access port in each chamber, other implementations may include only one chamber having direct access via an access port. Moreover, neither chamber may be provided with an access port, and the medicament contained with the chambers may be accessed by puncturing the body portion with a needle.

Figure 6:
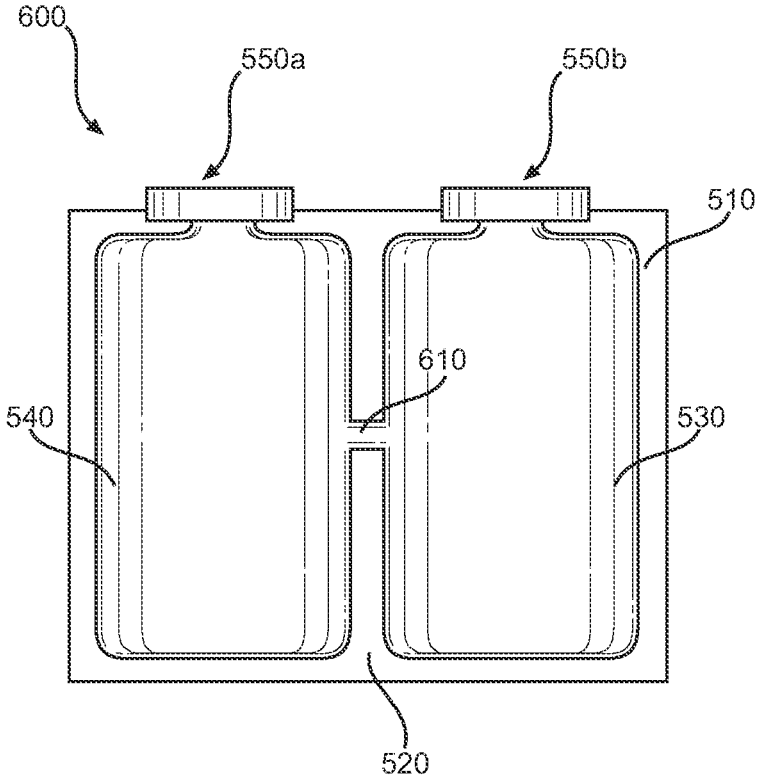
FIG. 6 is a schematic cross-sectional view of another embodiment of a drug container having a channel between two chambers.

Turning to FIG. 6, another implementation of the present disclosure is illustrated in which in which a container 600 comprises more than one internal chamber. More particularly, the container 600 comprises a first inner chamber 540 and a second inner chamber 530, wherein a channel 610 in the septum 520 fluidly connects the first and second inner chambers. In other implementations, there may be more than one channel 610, and there may be more than two chambers connected via such a plurality of channels. According to some aspects, the channel 610 may comprise a valve, such as a one-way valve, to allow a flow of fluid in a first direction, but prevent the flow of fluid in the opposite direction. In some aspects, the valve may be a self-sealing valve, such as a slit valve. Other temporary sealing members may also be provided in the channel 610.

Figure 7A:
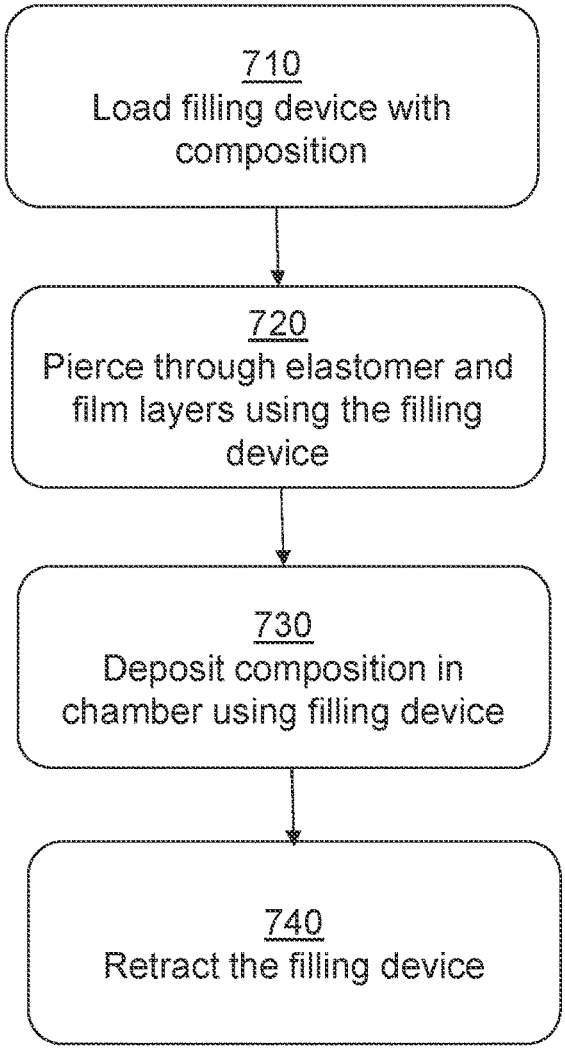
FIGS. 7A and 7B are flowcharts setting out methods for use of a drug container according to the present disclosure.
Figure 7B:
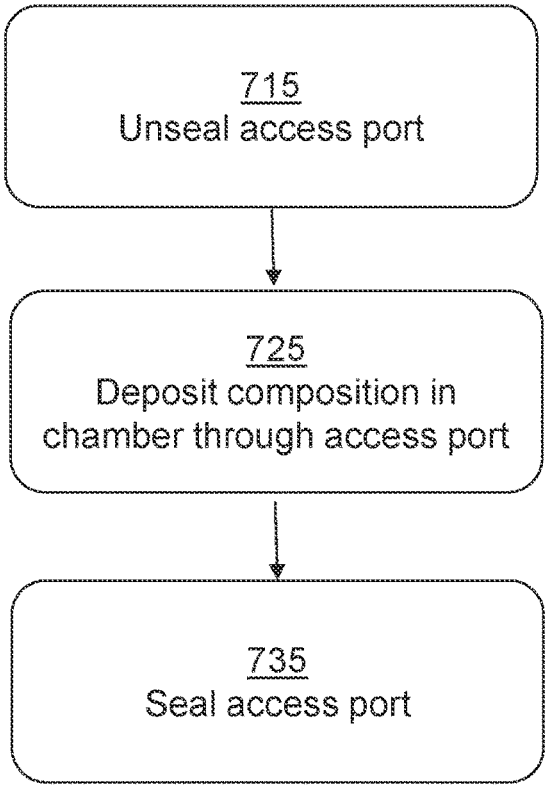

FIGS. 7A and 7B show two respective flowcharts setting out methods for using a container as described herein. In particular, FIG. 7A provides steps for the filling of a container 100 as shown in FIG. 1, i.e., a container 100 with an access port which is comprised of the elastomeric material of the body portion 110. These steps described in FIG. 7A also apply to filling a container without an access port.

Firstly, in step 710, a filling device is loaded with the pharmaceutical composition to be stored in the container 100. Examples of such a filling device include a syringe, a filling machine and the like. For instance, a filling needle may be used for transferring the pharmaceutical composition to the container. In step 720, the filling needle of the filling device loaded with the pharmaceutical composition is pierced through the body portion 110 and inner lining 200 layers which surround the internal chamber 310 of the container. For instance, in the implementation shown in FIG. 1, the container 100 includes a specified access port 250 that comprises elastomeric material, such that the filling needle may pierce through the surface of the access port 250 and into the opening 360 of the inner lining 200 in order to gain access to the internal chamber 310. In other implementations of the container where there is no specified access port, the filling needle may pierce through any section of the elastomeric body portion of the container. In step 730, the composition is deposited into the internal chamber 310 in the appropriate manner. For example, the contents of the filling device are discharged into the container by depressing a plunger of a syringe. Finally, in step 740, the needle of the filling device is retracted. The container 100 is then resealable upon removal of the needle at the point of needle puncture. In some aspects, the container may reflexively reseal after puncture, due to the nature of the elastomeric material and the inner film sheets (e.g., elastomers having self-sealing properties). Alternatively or additionally, the container may be formed such that at least the portion of the container that is punctured is partially cured prior to filling, and fully cured after filling. The final cure may occur, for example, during sterilization with the application of UV light, radiation, or heat.

Accordingly, the pharmaceutical composition may thus be safely stored in the internal chamber 310 of the container 100. It will be appreciated that any device that is capable of piercing through the elastomer and thermoplastic layers of the container may be used to carry out the method steps of FIG. 7A. In some implementations, the volume of the pharmaceutical composition to be deposited into the internal chamber may exceed that of the filling device being used. Thus, steps 710 through 740 may be repeated until the desired amount of the pharmaceutical composition has been adequately deposited within the internal chamber 310.

FIG. 7B provides steps for the filling of a container 400 having an access port 450, such as implementation shown in FIG. 4A. The access port 450 provides a specified point or area of the container 400 through which the composition may be deposited into one or more of the internal chambers. Such an access port may be open-ended or sealed. Such a sealed access port may be sealed with a mechanical seal or a similar device.

In step 715, the access port 450 is first unsealed. In some implementations, the access port 450 may be resealable, and hence the act of unsealing may further involve removing a stopper or other closing device, such as a clip, from the access port 450, or providing the container prior to application of the closing device. In other implementations, the access port is not resealable, and thus the container 400 must be filled prior to the sealing of the access port. Next, in step 725, the pharmaceutical composition is deposited in the chamber through the access port 450. This may be achieved using any appropriate means, such as with a syringe. In embodiments where an internal via 405 is present, the pharmaceutical composition passes through the via 405 in order to enter the internal chamber 433. Finally, in step 735, the access port 450 is sealed or resealed. This may involve placing a closure device 470 in the access port 450, for example, and/or using thermal means or otherwise to seal the access port 450.

Figure 8A:
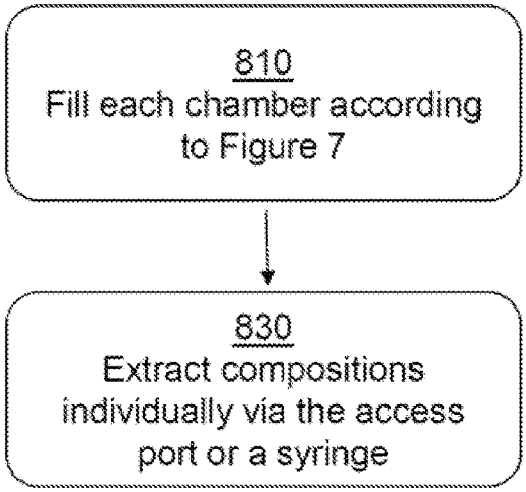
FIGS. 8A and 8B are flowcharts setting out methods for use of the drug containers depicted in FIGS. 5 and 6, respectively.
Figure 8B:
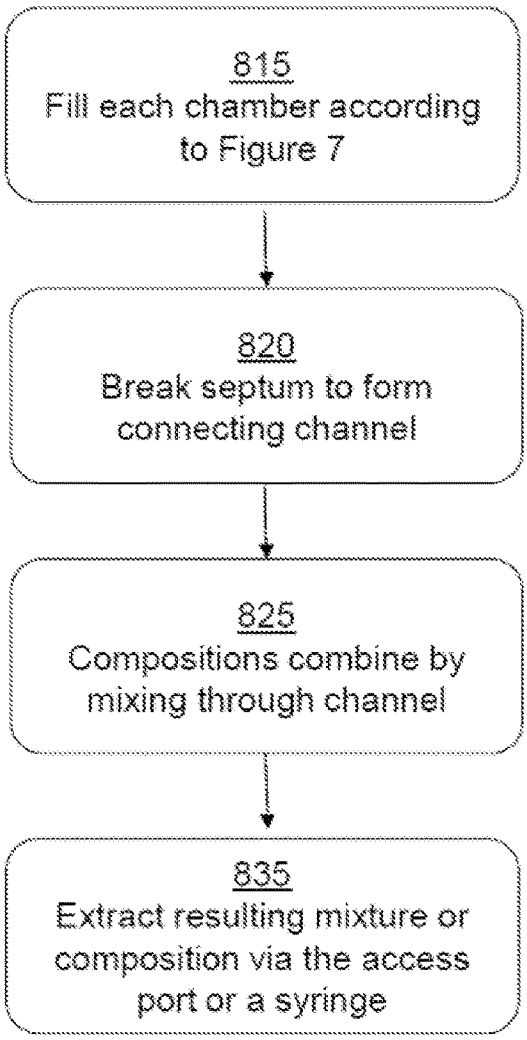

FIGS. 8A and 8B are flowcharts setting out methods for use of the container implementations shown in FIGS. 5 and 6, respectively. In particular, FIG. 8A sets out a method of filling the container 500. In step 810, one or more pharmaceutical compositions are deposited in one or more of the inner chambers according to at least one of the methods previously described in FIGS. 7A and 7B above. The pharmaceutical composition deposited in each chamber need not be the same. Once the container has been filled with the pharmaceutical compositions, and has been resealed, if appropriate, the pharmaceutical compositions remain segregated due to the presence of the septum 520. In step 830, the compositions are extracted individually. This may be achieved by extracting the composition using a syringe, by extracting the composition through the first access port 550*a* or the second access port 550*b*, or a combination thereof. Alternatively, the internal volume of the container 500 may be pressurized to expel the internal fluid after piercing the walls of the container 500 with a needle, or external compression may be applied to the container in order to expel the internal fluid.

FIG. 8B sets out a method of filling the container 600. In step 815, one or more pharmaceutical compositions are deposited in one or more of the inner chambers according to at least one of the methods outlined in FIGS. 7A and 7B. The pharmaceutical composition deposited in each chamber need not be the same. Thus, the container 600 has been filled with the pharmaceutical compositions, and the container has then been resealed, if appropriate. In step 820, a section of the septum 520 is then broken, such that a channel 610 is formed connecting the first and second inner chambers 540, 530. In step 825, the pharmaceutical compositions may move through the channel 610 adjoining the inner chambers. This may result in the formation of a mixture or composition which is different to the pharmaceutical compositions initially deposited in one or more of the chambers. In step 835, the resulting mixture or composition is then extracted. This may be achieved by extracting the composition using a syringe, or by extracting the composition through the access port. Alternatively, the internal volume of the container may be pressurized to expel the internal fluid after piercing the walls of the container with a needle, or external compression may be applied to the container in order to expel the internal fluid.

Figure 9:
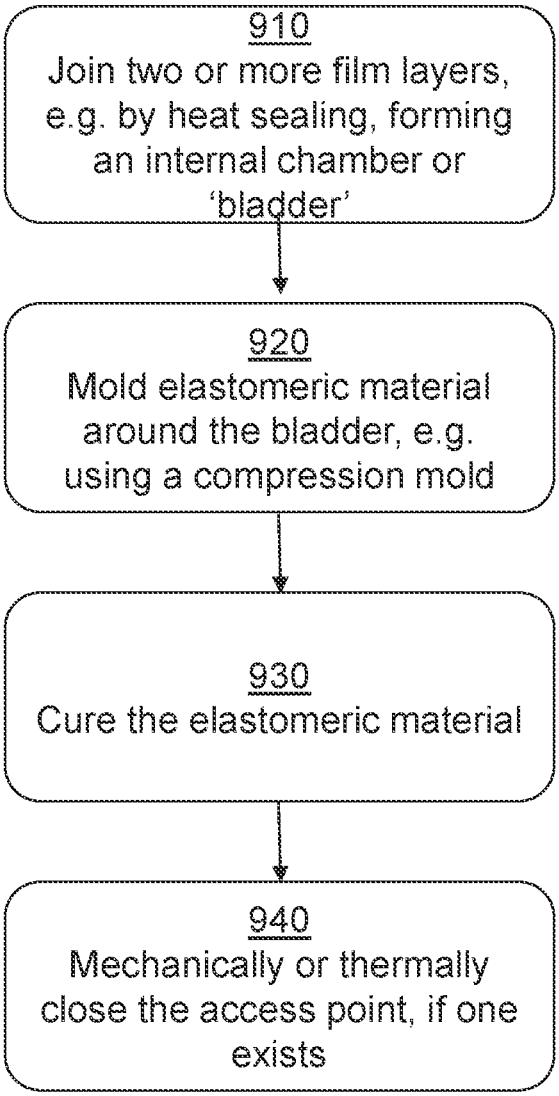
FIG. 9 is a flowchart setting out a method of fabrication of a drug container according to the present disclosure.

Lastly, FIG. 9 is a flowchart setting out a method of fabrication of a container 100. In step 910, a folded sheet or two or more sheets of thermoplastic film are sealed in order to form the internal chamber 310 of the container 100. The sealing mechanism may be, for example, heat sealing or the use of a pharmaceutical grade adhesive. Opposing faces of the film sheet(s) are sealed around the edges 330 as shown in FIG. 3B. For implementations utilizing heat sealing, such heat sealing is made possible due to the thermoplastic properties of the film, which allow it to become plastic upon heating and to harden when cooled. Such heat sealing may be carried out in any appropriate manner. For example, hot-bar welding or impulse welding may be employed to simultaneously apply heat and pressure to the edges 330 of the film, causing the edges 330 to become plastic and furthermore join together. The source of heat and pressure is then removed. The now-sealed edges 330 of the film will subsequently cool and harden, leaving a 'bladder'-like film bag or pouch forming the internal chamber of the container. In some implementations, the sealed edges 330 may only partially enclose the internal chamber 310 in order to facilitate the addition of an access port 250 to the container. An opening 360 may be created by leaving a portion of the edges unsealed, such that a space remains between the inner lining sheets of thermoplastic material at that location. This opening 360 provides an entry point through which to deposit the pharmaceutical composition into the internal chamber 310, i.e., via a syringe needle.

For implementations of the container which further comprise an internal via 405, the inner lining sheets may be sealed in such a manner as to allow for at least a portion of the inner surface 407 of the internal via 405 to be covered by an inner lining 422. This may be achieved by sealing the sheets such that there remains an opening, and wherein a molding the elastomeric material around the internal chamber includes the opening. The opening provides an entry point through which to deposit the pharmaceutical composition, and the via provides a passage through which the pharmaceutical composition passes into the internal chamber.

Implementations of the container which comprise multiple chambers may be formed through the addition of one or more sealed sections which segment the initial internal chamber 310 into two or more separate chambers. The sealed sections form a shared wall or septum 520 between inner chambers, as shown in FIG. 5. There may be one or more unsealed or easily broken sections in such a sealed section, to facilitate the formation of one or more channels connecting the inner chambers. Alternatively, there may be one or more openings in such a sealed section, to facilitate the addition of channels connecting the inner chambers. Moreover, each internal chamber may be formed from individual sheets of thermoplastic film, which are then attached by any appropriate means to form the multiple chambers. In other implementations, the sealed edges 330 may only partially enclose one or more of the internal chambers, to facilitate the addition of one or more access ports to the container. Such openings may be created by leaving a portion of the edges unsealed, so that a space remains between the thermoplastic sheets at that location. These openings provide entry points through which to deposit the pharmaceutical compositions into the inner chambers.

In step 920, the body portion 110 is formed around the internal chamber. This is achieved by molding the elastomeric material around the internal chamber by using compression molding, injection molding, or any other appropriate molding technique. For implementations including an access port 450, the access port 450 will be incorporated into the molding of the elastomeric material. This may involve molding the access port to comprise an open end, or to have an elastomeric seal. At this stage, external features may be molded as part of the body portion 110. This may include inmolded or shaped features such as valves or mechanical closures, among others.

Steps 910 and 920 may be performed simultaneously. For example, two elastomeric sheets each having a thermoplastic layer applied to one side may be molded together after orienting the elastomeric sheets, such that the thermoplastic layers face each other. Alternatively, a single elastomeric sheet having a thermoplastic layer applied to one side may be folded onto itself prior to molding. The elastomeric sheet may be folded, such that the thermoplastic layer is located internally. For implementations including an internal via 405, the external surface of the via is incorporated into the molding of the elastomeric material. This may be achieved by molding the elastomeric material around the reduced diameter portion of the internal chamber which defines the internal via, i.e., extending outward from the internal chamber.

In step 930, the elastomeric material is cured. This results in the elastomeric material crosslinking, thus surrounding the internal chamber with an elastomeric containment structure. Any appropriate means of curing an elastomeric material may be used. For example, the elastomeric material may be cured with the application of heat in an autoclave or during molding (e.g., compression molding). Alternatively, the elastomeric material may be cured by radiation or by a chemical cure. The external surface may optionally be provided with coatings or labels to add functionality or to alter the appearance of the container. This may include, for instance, adding a non-slip coating to the external surface, or printing onto the external surface using ink.

In step 940, any access port formed in step 920 is subsequently sealed. This may be achieved through the use of a mechanical seal, such as a clip, a fastener or other external closure device which will close the open end by pressing the outer layers of the container together, thus imitating the seal present around the perimeter of the container 100. In other implementations, the mechanical seal is a stopper or similar hybrid internal/external closure device, where at least a portion of the surface of the stopper is in fluid contact with the contents of the internal chamber of the container. Such a mechanical seal may comprise elastomeric material. As previously mentioned, in order to protect the pharmaceutical composition from potential leachables or extractables in such elastomeric material, the inner surface of the mechanical seal may comprise a thermoplastic film layer which acts as a barrier to protect the pharmaceutical composition. The access port may otherwise be sealed by thermal means. This may be achieved by heat sealing (e.g., hot-bar welding, impulse welding and the like) the opening 360 in the thermoplastic sheets, such that the internal chamber is fully enclosed within the sheets.

It will be appreciated that the steps of the methods described above need not be carried out in the order presented in the figures, and they may instead be carried out in any order. Moreover, while certain implementations of a container for storing pharmaceutical compositions, and the associated methods of use and fabrication of such a container, have been described in terms of what may be considered to be specific aspects, the present disclosure is not limited to the disclosed aspects. Additional modifications and improvements to the aforementioned containers may be apparent to those skilled in the art. Furthermore, implementations described and shown in the accompanying drawings are provided as examples of ways in which the container may be put into effect and are not intended to be limiting on the scope of the disclosure. Modifications may be made, and elements may be replaced with functionally and structurally equivalent parts, and features of different embodiments may be combined without departing from the disclosure. The many features and advantages of the disclosure are apparent from the detailed specification, and thus, it is intended by the appended claims to cover all such features and advantages of the present disclosure which fall within the spirit and scope of the disclosure.

What is claimed is:

1. A container comprising:

a body portion comprising an elastomeric material;

an inner lining comprising a thermoplastic material covering at least a portion of an inner surface of the body portion;

a plurality of internal chambers for storing one or more pharmaceutical compositions; and a channel connecting two or more of the plurality of internal chambers, wherein the plurality of internal chambers are bounded by the inner surface of the body portion, and the inner lining is configured to provide a barrier between the elastomeric material and the one or more pharmaceutical compositions.

2. The container of claim 1, wherein the elastomeric material comprises a thermoelastic elastomer or a thermoset elastomer.

3. The container of claim 1, wherein the elastomeric material is a pharmaceutical grade elastomeric material.

4. The container of claim 1, wherein the inner lining comprises a laminate of a plurality of sheets, and wherein each sheet of the plurality of sheets comprises at least one thermoplastic material.

5. The container of claim 1, wherein the channel is sealed by a breakable seal, and the seal prevents fluid communication between the two or more of the plurality of internal chambers until the seal is broken.

6. The container of claim 1, further comprising an access port in fluid communication with at least one of the internal chambers.

7. The container of claim 6, wherein the access port comprises the elastomeric material and extends from the body portion of the container.

8. The container of claim 6, wherein at least a portion of an internal surface of the access port is covered by the inner lining.

9. The container of claim 8, wherein the access port has a sealed end.

10. The container of claim 9, wherein the sealed end is resealable.

11. The container of claim 8, wherein the access port extends from the body portion of the container and comprises an open end sealed with a closure device.

12. The container of claim 11, where the closure device is an elastomeric stopper.

13. The container of claim 1, further comprising a valve in the channel.

14. The container of claim 13, wherein the valve is a one-way valve that allows fluid flow in a first direction but prevents fluid flow in a second direction that is the opposite of the first direction.

15. The container of claim 6, wherein the access port provides access to one of the plurality of internal chambers, and the container comprises another access port providing access to another of the plurality of internal chambers.

16. A method comprising:

filling a first internal chamber of a container with a pharmaceutical composition; and filling a second internal chamber of the container with the same or a different pharmaceutical composition, wherein a channel connects the first internal chamber and the second internal chamber, the container comprises a body portion comprising an elastomeric material and an inner lining comprising a thermoplastic material covering at least a portion of an inner surface of the body portion, the first internal chamber and the second internal chamber are bounded by the inner surface of the body portion, and the inner lining provides a barrier between the elastomeric material and the pharmaceutical composition or the different pharmaceutical composition.

17. The method of claim 16, wherein the channel has a seal preventing fluid communication between the first internal chamber and the second internal chamber until the seal is broken.

18. A method of manufacturing a container, the method comprising:

forming a body portion defining a first chamber having a first internal volume, a second chamber having a second internal volume, and a channel connecting the first chamber and the second chamber, wherein the body portion comprises an elastomeric material and an inner lining comprising a thermoplastic layer covering at least a portion of an inner surface of the body portion, the first internal chamber and the second internal chamber are bounded by the inner surface of the body portion, and the inner lining provides a barrier between the elastomeric material and the first internal volume and the second internal volume.

19. The method of claim 18, further comprising forming a bladder from the thermoplastic layer of the inner lining material.

20. The method of claim 19, further comprising forming the body portion around the bladder and subsequently curing the elastomeric material.

21. The method of claim 20, further comprising leaving a section of an edge of the body portion unsealed so that an opening is formed in the inner lining.

22. The method of claim 18, further comprising forming a breakable seal in the channel, wherein the seal prevents fluid communication between the first internal chamber and the second internal chamber until the seal is broken.

* * * * *